US005697404A

United States Patent [19]

Cheng et al.

[11] Patent Number: 5,697,404

[45] Date of Patent: Dec. 16, 1997

[54] ROTARY TO RECIPROCATING DRIVE FOR A MAGNETIC SHUTTLE CARRIAGE

[76] Inventors: Chuan-tien Cheng, 2nd Fl., No. 25, Sec. 2, Szuchuan Rd., Panchiao, Taipei Hsien, Taiwan; Wu-chen Chuang, No. 102, Yumin St., Tainan, Taiwan

[21] Appl. No.: 705,052

[22] Filed: Aug. 29, 1996

[51] Int. Cl.[6] ..... D03D 49/44

[52] U.S. Cl. ..... 139/134; 74/25

[58] Field of Search ..... 74/25; 139/134

[56] References Cited

U.S. PATENT DOCUMENTS

| | | | |
|---|---|---|---|
| 4,624,287 | 11/1986 | Kakilashvili et al. | 139/134 |
| 4,889,438 | 12/1989 | Forsyth et al. | 74/25 |
| 4,901,768 | 2/1990 | Chi-Shuang | 139/134 |
| 5,058,629 | 10/1991 | Huang | 139/134 |

*Primary Examiner*—Andy Falik

*Attorney, Agent, or Firm*—Welsh & Katz, Ltd.

[57] ABSTRACT

An apparatus for driving a carriage of a shuttle in a weaving loom consists of a housing, a driven shaft rotatably mounted in the housing and a driving wheel rotatably mounted in the housing and having an axis of rotation orthogonal to that of the driven shaft. A spool is fixedly mounted on the driven shaft. A wire has an end fixedly attached on the spool and another end connected to a carriage. A plurality of rollers are attached on a circumferential periphery of the driven shaft. One of the rollers is engaged with one of a plurality of guiding channels defined on a circumferential periphery of the driving wheel. The guiding channels are so configured that when the driving wheel rotates, the driven shaft can repeatedly have the following modes of movement: firstly remaining in a static state, rotating and accelerating in a first direction, decelerating, staying in another static state, rotating and accelerating in a second direction, decelerating, and finally returning to the first static state.

11 Claims, 4 Drawing Sheets

ROTARY TO RECIPROCATING DRIVE FOR A MAGNETIC SHUTTLE CARRIAGE

FIELD OF THE INVENTION

The present invention is related to an apparatus for driving a carriage of a shuttle in a weaving loom, particularly to an apparatus for driving a carriage of a shuttle in a weaving loom wherein the shuttle is motivated by the carriage by magnets.

BACKGROUND OF THE INVENTION

A weaving loom is equipped with magnets on a carriage to motivate a shuttle to have a reciprocal movement along a sley to achieve a picking motion. The shuttle is accelerated from a static state to reach a predetermined speed to perform a picking motion. Then, the shuttle is quickly decelerated to reach another static state and it remains in the static state for while whereby a beating motion can be performed. After the beating motion is completed, the shuttle is then accelerated again from the static state but moving in an opposite direction to reach the predetermined speed to perform another picking motion. Since the shuttle performs the picking motion in both the forward and backward movements, a specially designed driving apparatus is required for driving the carriage which motivates the shuttle by magnets.

By a further analysis, it is understood that during the picking motion, the carriage which motivates the shuttle by magnets is firstly accelerated from a static state to reach a predetermined speed. Then, the carriage is quickly decelerated to reach another static state and it remains in the state for a while so that a beating motion can be performed. Thereafter, the carriage is accelerated again from the static state but moving in an opposite direction to reach the predetermined speed. Then, the carriage is quickly decelerated again to reach the first static state and stays in the state for a while. Thereafter, the carriage repeats the above movements.

Conventionally, the power source for driving the carriage is a motor which normally can only provide a unidirectional movement of rotation. In order to enable the carriage to have a reciprocal movement along the slay, a driving apparatus is required between the motor and the carriage which can convert the unidirectional rotation of the motor into a reciprocal movement of the carriage along the slay.

A conventional apparatus for driving a carriage of a shuttle in a weaving loom includes a link having an end connecting a disk attached on a shaft of a motor and another end connecting an input disk of a transmission mechanism. When the shaft of the motor rotates in a particular direction, the input disk can have a bidirectional pivotal movement. The bidirectional pivotal movement of the input disk is transmitted to a spool via the transmission mechanism so that the spool can also have a bidirectional pivotal movement like that of the input disk but in a higher speed. A wire is used to connect the spool and the carriage via a set of wire pulleys so that when the spool has a bidirectional pivotal movement, the carriage can have a reciprocal movement along a slay thereby to enable a shuttle motivated by the carriage to achieve the above-mentioned picking motion.

Since the above-mentioned conventional apparatus for driving a carriage of a shuttle needs a link to convert a unidirectional rotation of a motor into a bidirectional pivotal movement of an input disk and a transmission mechanism to convert the bidirectional pivotal movement of the input disk into a bidirectional pivotal movement of a spool in a higher speed, the structure of the conventional apparatus is relatively complicated. Moreover, the transmission mechanism of the conventional apparatus is a planetary gear set which is very expensive. Furthermore, a maintenance of the planetary gear set is difficult.

The present invention therefore is aimed to provide an improved apparatus for driving a carriage of a shuttle in a weaving loom to mitigate and/or obviate the aforementioned problems.

SUMMARY OF THE INVENTION

An objective of the present invention is to provide an apparatus for driving a carriage of a shuttle in a weaving loom wherein the structure of the apparatus is relatively simple.

Another object of the present invention is to provide an apparatus for driving a carriage of a shuttle in a weaving loom wherein the cost of the apparatus is low.

A further objective of the present invention is to provide an apparatus for driving a carriage of a shuttle in a weaving loom wherein the maintenance of the apparatus is simple.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
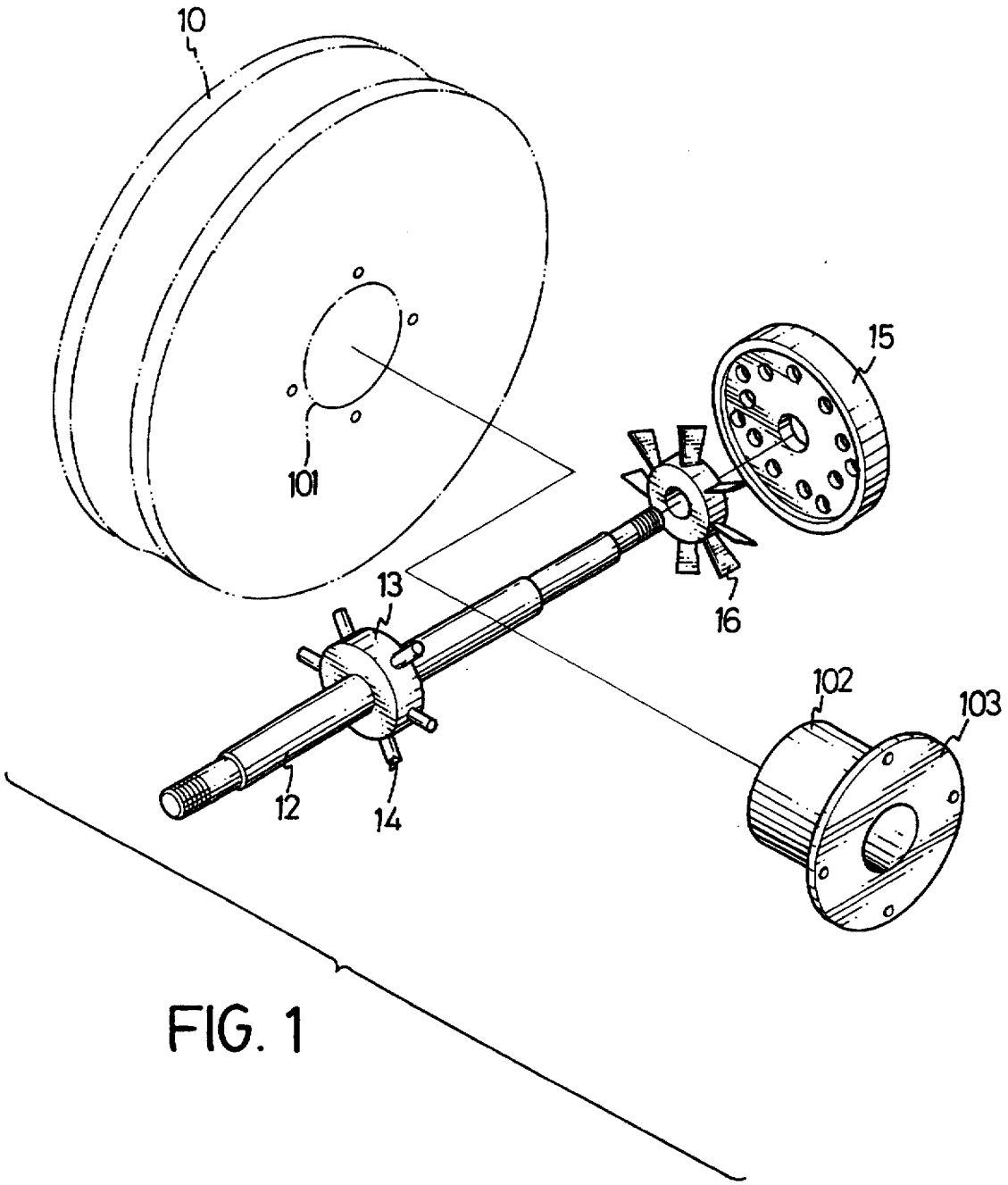
FIG. 1 is a front-right-top perspective view showing the main parts for constituting an apparatus for driving a carriage of a shuttle in a weaving loom in accordance with the present invention.

Referring to FIG. 1, main parts for constituting an apparatus for driving a carriage of a shuttle in a weaving loom are shown. The apparatus mainly consists of a driving wheel 10 defining a central hole 101, a driven shaft 12, a spool 15, a fan 16 and a bushing 102 defining a flange 103. The driven shaft 12 is formed to have an enlarged portion 13 on a circumferential periphery thereof. Six rollers 14 are attached on the enlarged portion 13, wherein the six rollers 14 are equally spaced from each other. The spool 15 and the fan 16 are fixedly mounted on an end of the driven shaft 12 via a nut (not shown) engaging with a threaded portion (not labeled) of the driven shaft 12. Four small holes (not labeled) are defined in the driving wheel 10 and near the central hole 101. Four corresponding small holes (not labeled) are defined in the flange 103 of the bushing 102. The driving wheel 10 is formed to have a groove-like profile along a central portion of a circumferential periphery thereof (better seen in FIG. 2).

Figure 2:
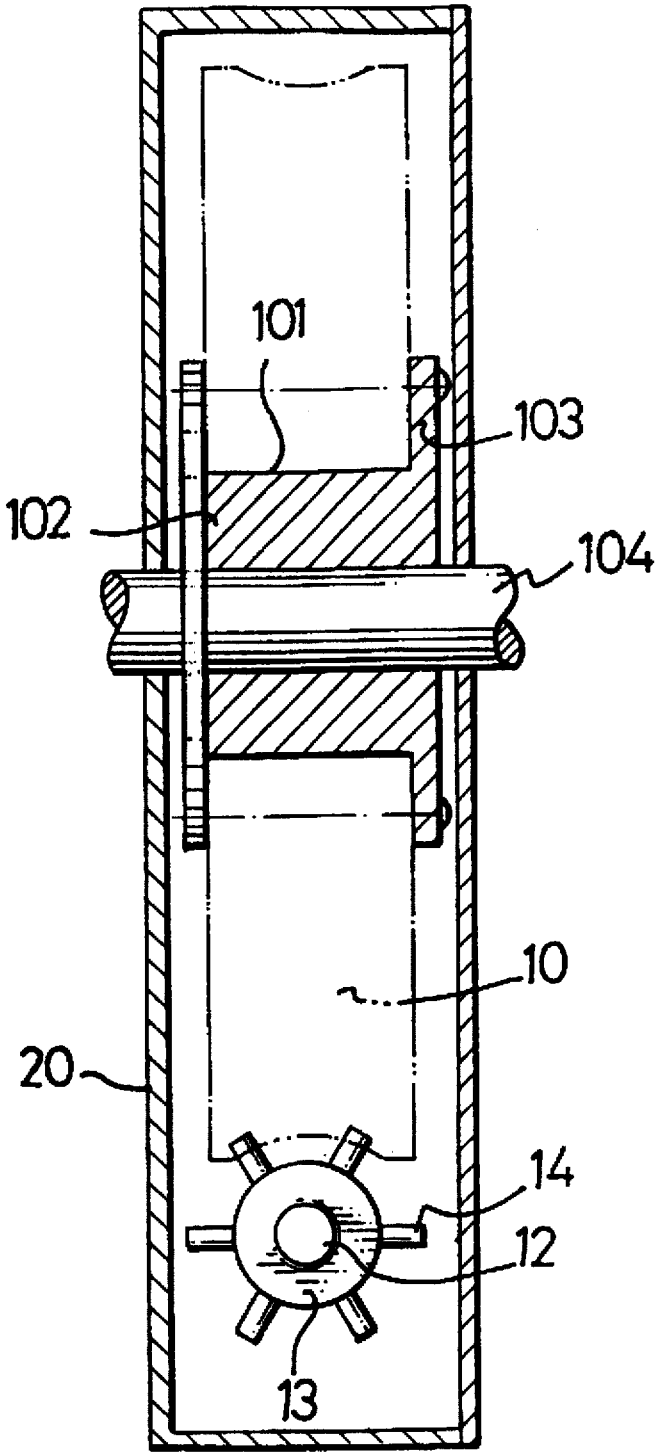
FIG. 2 is front, cross-sectional view showing that the main parts of FIG. 1 of the present invention are assembled in a housing.

Now please refer to FIG. 2 which shows that the driving wheel 10, the driven shaft 12 and the bushing 102 are assembled in a housing 20. When assembling these parts (also referring to FIG. 7), firstly, the driven shaft 12 is rotatably mounted in the housing 20 at a predetermined position. Then, the driving wheel 10 is mounted into the housing 20 to a position that one of the guiding channels 11 (better seen in FIGS. 3 to 6) defined on the circumferential periphery of the driving wheel 10 is slideably engaged with one of the rollers 14. Then, the bushing 102 is inserted into the central hole 101 to fixedly engage with a driving shaft 104 of the driving wheel 10. Finally, four screws (not labeled) are used to threadedly engage with the four small holes respectively defined in the flange 103 of the bushing 102 and the driving wheel 10 thereby to fixedly connect the driving shaft 104 and the driving wheel 10 together so that when the driving shaft 104 rotates, the driving wheel 10 can rotate accordingly. From FIG. 2, it is understood that the axis of rotation of the driven shaft 12 is orthogonal to the axis of rotation of the driving shaft 104 and the driving wheel 10.

Now please refer to FIGS. 3 to 6 which show that a plurality of guiding channels 11 are defined in the circumferential periphery of the driving wheel 10.

Figure 3:
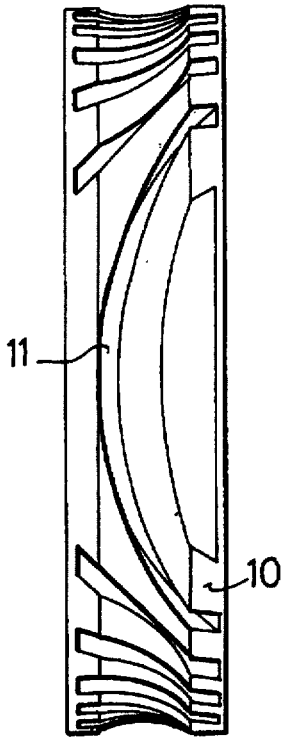
FIG. 3 is a front view showing the details of a circumferential periphery of a driving wheel of the present invention.

As shown by FIG. 3, a first arc-shaped guiding channel is defined on a central portion of the circumferential periphery of the driving wheel 10. The first arc-shaped guiding channel extends from a right, upper corner of the circumferential periphery of the driving wheel 10 through a left side to a right, lower corner thereof. The other guiding channels are formed to respectively have a curved configuration with a different curvature. The other guiding channels, which are located above the first arc shaped guiding channel, each have an orientation extending from the left side of the circumferential periphery of the driving wheel 10 upwardly to a right side thereof and define a curve having a concave side substantially facing a right and lower portion of the circumferential periphery of the driving wheel 10. The other channels, which are located below the first arc-shaped guiding channel, each have an orientation extending from the left side of the circumferential periphery of the driving wheel 10 downwardly to the right side thereof and define a curve having a concave side substantially facing a right, upper portion of the circumferential periphery of the driving wheel 10. The first arc-shaped guiding channel has a length which is the longest of the other guiding channels in FIG. 3. The other guiding channels have lengths and curvatures respectively gradually decreasing in proportion to their distances from the first arc-shaped guiding channel.

Figure 5:
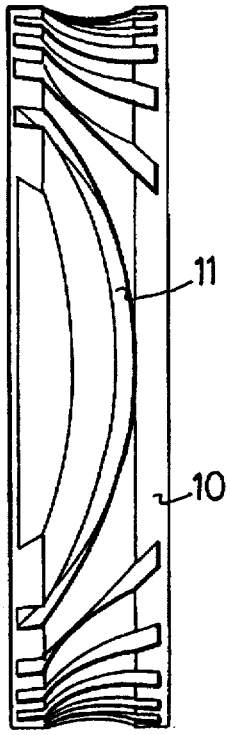
FIG. 5 is a view similar to FIG. 4 but showing that the driving wheel is further rotated about 45° from FIG. 4.
Figure 4:
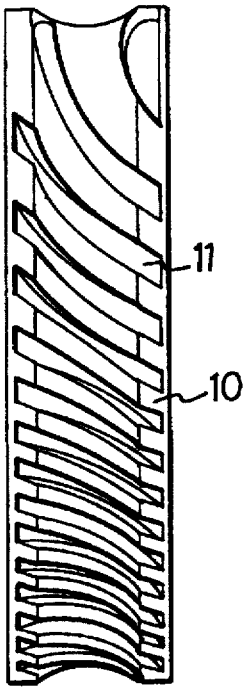
FIG. 4 is a view similar to FIG. 3 but showing that the driving wheel is rotated about 45° from FIG. 3, wherein the driving wheel is rotated clockwise as viewed from FIG. 1.

FIG. 4 shows that the driving wheel 10 is rotated about 45° from FIG. 3, wherein the driving wheel 10 is rotated clockwise as viewed from FIG. 1. The top guiding channel in FIG. 4 is a lower portion of the first arc-shaped guiding channel of FIG. 3. In FIG. 4, there is a first horizontal guiding channel which is horizontally extended and located amid the first arc-shaped guiding channel and a second arc-shaped guiding channel (FIG. 5). Located above the first horizontal guiding channel and below the first arc-shaped guiding channel, the guiding channels each have a length and curvature gradually decreasing in proportion to their distances from the first arc-shaped guiding channel, and define a curve having a concave side substantially facing a right, upper portion of the circumferential periphery of the driving wheel 10 and have an orientation extending from the left side of the circumferential periphery of the driving wheel 10 downwardly to the right side thereof. The other guiding channels, which are located below the first horizontal guiding channel each have a length and curvature gradually increasing in proportion to their distances from the first horizontal guiding channel, and define a curve having a concave side substantially facing a left, lower portion of the circumferential periphery of the driving wheel 10 and have an orientation also extending from the left side the circumferential periphery of the driving wheel 10 downwardly to the right side thereof.

FIG. 5 shows that the driving wheel 10 is further rotated about 45° from FIG. 4. The second arc-shaped guiding channel as shown in FIG. 5 is located on a central portion of the circumferential periphery of the driving wheel 10 and extends from a left, upper corner of the circumferential periphery of the driving wheel 10 through a right side to a left, lower corner thereof. The other guiding channels, which are located above the second arc-shaped guiding channel, each have an orientation extending from the left side of the circumferential periphery of the driving wheel 10 downwardly to a right side thereof and define a curve having a concave side substantially facing a left and lower portion of the circumferential periphery of the driving wheel 10. The other channels, which are located below the second arc-shaped guiding channel, each have an orientation extending from the left side of the circumferential periphery of the driving wheel 10 upwardly to the right side thereof and define a curve having a concave side substantially facing a left, upper portion of the circumferential periphery of the driving wheel 10. The second arc-shaped guiding channel has a length which is the longest of the other guiding channels in FIG. 5 and is equal to that of the first arc-shaped guiding channel. The other guiding channels have lengths and curvatures respectively gradually decreasing in proportion to their distances from the second arc-shaped guiding channel.

Figure 6:
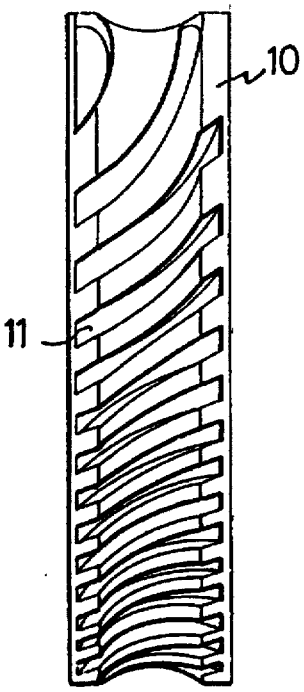
FIG. 6 is a view similar to FIG. 5 but showing that the driving wheel is further rotated about 45° from FIG. 5.

FIG. 6 shows that the driving wheel 10 is further rotated about 45° from FIG. 5. The top guiding channel in FIG. 6 is a lower portion of the second arc-shaped guiding channel in FIG. 5. In FIG. 6, there is a second horizontal guiding channel which is horizontally extended and located amid the second arc-shaped guiding and the first second arc-shaped guiding channel (FIG. 3). Located above the second horizontal guiding channel and below the second arc-shaped guiding channel, the guiding channels each have a length and curvature gradually decreasing in proportion to their distances from the second arc-shaped guiding channel, and define a curve having a concave side substantially facing a left, upper portion of the circumferential periphery of the driving wheel 10 and have an orientation extending from the left side of the circumferential periphery of the driving wheel 10 upwardly to the right side thereof. The other guiding channels, which are located below the second horizontal guiding channel in FIG. 6, each have a length and curvature gradually increasing in proportion to their distances from the second horizontal guiding channel, and define a curve having a concave side facing a right, lower portion of the circumferential periphery of the driving wheel 10 and have an orientation also extending from the left side of the circumferential periphery of the driving wheel 10 upwardly to the right side thereof.

Figure 7:
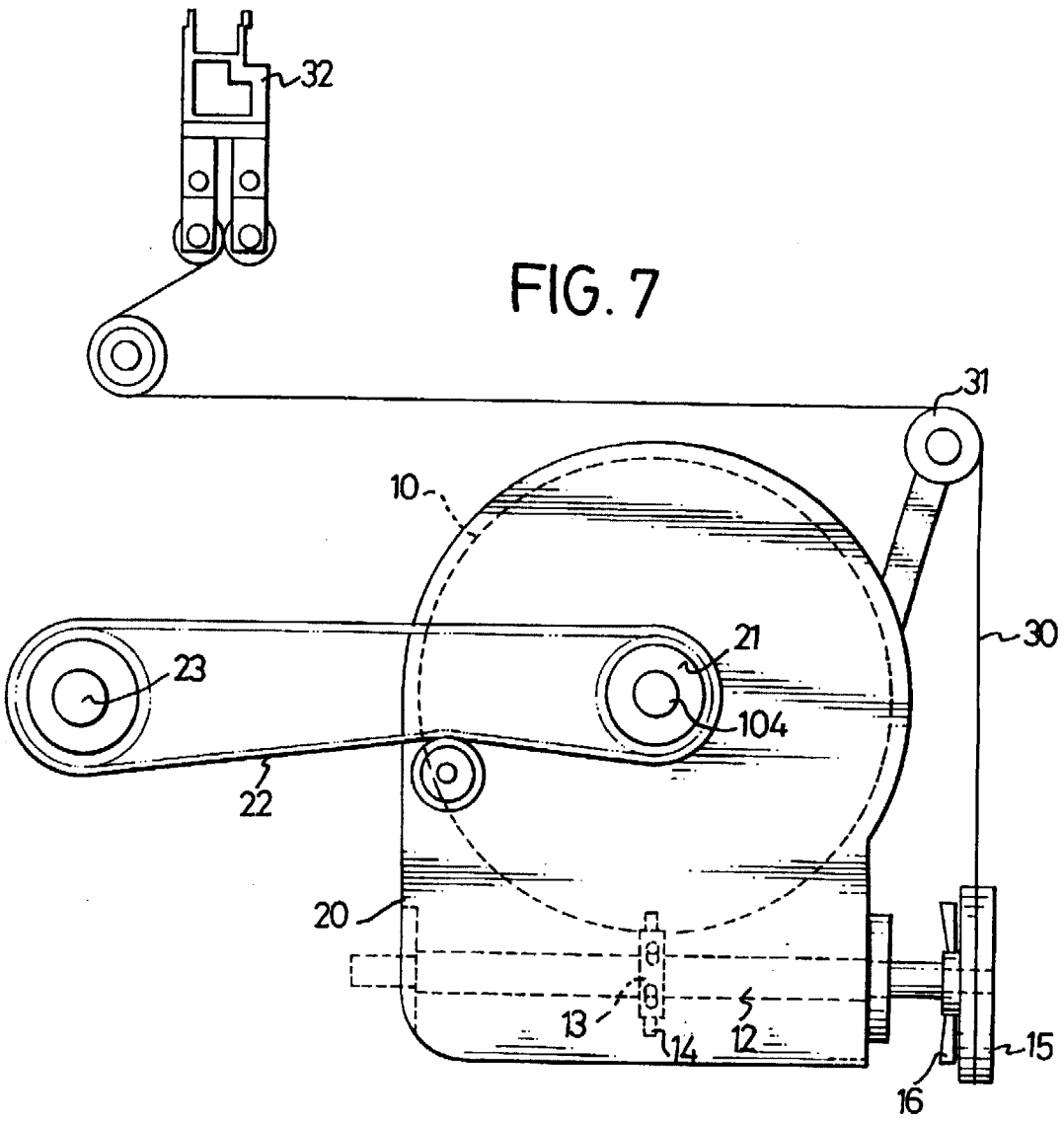
FIG. 7 is a diagrammatically right side view showing that an apparatus in accordance with the present invention is arranged to connect with a part of a carriage to enable the carriage to have a reciprocal movement.

Refer to FIG. 7 which shows that the driving shaft 104 of the driving wheel 10 is fixedly connected with a first belt pulley 21. A belt 22 is used to connect the first belt pulley 21 with a second belt pulley (not labeled) which is fixedly attached with an output shaft 23 of a motor (not shown) so that when the motor is started, the driving wheel 10 can rotate in one direction (for example, in a clockwise direction as viewed from FIG. 7). Provided that before the motor is started, one of the rollers 14 of the driven shaft 12 is engaged with the first arc-shaped guiding channel as shown in FIG. 3, when the motor is started to drive a rotation of the driving wheel 10, the roller will move along the first arc-shaped guiding channel, in which the driven shaft 12 will substantially have no rotation. This means that the driven shaft 12 and the spool 15 are in a static state. As the driving wheel 10 continues to rotate, thereafter, the rollers 14 will sequentially engage the guiding channels below the first arc-shaped guiding channel as shown in FIG. 4, in which the driven shaft 12 will have a clockwise rotation as viewed from a left side of FIG. 7 and the speed of rotation of the driven shaft 12 is accelerated from the static state to reach a maximum speed when one of the rollers 14 is engaged with and passing through the first horizontal guiding channel. Thereafter, the speed of rotation of the driven shaft 12 is decelerated with the same direction of rotation (i.e. clockwise) until one of the rollers 14 is engaged with and passing through the second arc-shaped guiding channel as shown in FIG. 5, in which the driven shaft 12 will substantially have no rotation. This means that the shaft 12 and the spool 15 are again in a static state. As the driving wheel 10 continues to rotate, thereafter, the rollers 14 will sequentially engage the guiding channels below the second arc-shaped guiding channel as shown in FIG. 6, in which the driven shaft 12 will have a counterclockwise rotation as viewed from the left side of FIG. 7 and the speed of rotation of the driven shaft 12 will be accelerated from the static state to reach maximum speed again when one of the rollers 14 is engaged with and passing through the second horizontal guiding channel. Thereafter, the speed of rotation of the driven shaft 12 is decelerated with the same direction of rotation (i.e. counterclockwise) until one of the rollers 14 is engaged with and passing through the first arc-shaped guiding channel as shown in FIG. 5, in which the driven shaft 12 is returned to its first static state. If the driving wheel 10 continues to rotate, the movement of the driven shaft 12 is repeated in accordance with the above-mentioned mode.

From the above descriptions, it is understood that when the driving wheel 10 is rotated one revolution, the driven shaft 12 and thus the spool 15 can obtain the following modes of movement: firstly in a static state, then, an acceleration in a first direction of rotation to reach a first maximum speed, a deceleration in the first direction to another static state, another acceleration in a second direction to reach a second maximum speed and finally another deceleration in the second direction to return to the first static state.

As shown in FIG. 7, a wire 30 has one end fixedly attached to the spool 15 and another end extending through a set of wire pulleys 31 to connect with a part 32 of a carriage (not shown) for driving a shuttle (not shown) by magnets (not shown). When the driven shaft 12 and the spool 15 are bidirectionally pivoted by the driving wheel 10, the spool 15 can move the part 32 and thus the carriage in connection therewith to have a reciprocal movement via the wire 30 thereby to enable the shuttle motivated by the carriage to achieve a picking motion.

Also referring to FIG. 7, the fan 16 is mounted near the spool 15 whereby an air flow generated by the fan 16 when it is rotated can dissipate heat generated between the wire 30 and the spool 15.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An apparatus for driving a carriage of a shuffle in a weaving loom, comprising:

a housing;

a driven shaft rotatably mounted in the housing, comprising a plurality of rollers attached on a circumferential periphery thereof and a spool fixedly connected therewith;

a driving wheel rotatably mounted in the housing, defining an axis of rotation orthogonal to an axis of rotation of the driven shaft and guiding channel means on a circumferential periphery of said driving wheel, said guiding channel means positioned to slidably engage with one of the rollers, said guiding channel means configured so that for one revolution of the driving wheel the spool first remains static, then is accelerated in a first rotational direction to reach a first maximum speed, then decelerated in said first direction to said static state, then again accelerated in a second rotational direction to reach a second maximum speed, and finally decelerated in said second rotational direction to return to said static state;

a motor for generating a unidirectional rotation of the driving wheel; and a wire having a first end fixedly attached with the spool and a second end adapted to be connected to a carriage.

2. The apparatus in accordance with claim 1, wherein a fan is mounted on the driven shaft and located near the spool.

3. The apparatus in accordance with claim 1 further comprising a belt pulley mounted on an output shaft of the motor, a further belt pulley mounted on a driving shaft of the driving wheel and a belt connecting said belt pulleys.

4. The apparatus in accordance with claim 1 further comprising a set of wire pulleys and wherein an end of the wire is extended through the wire pulleys to be adapted to be connected with the carriage.

5. The apparatus in accordance with claim 3 further comprising a bushing and wherein the driving wheel defines a central hole, the bushing being fixedly mounted in the central hole of the driving wheel and the driving shaft of the driving wheel being fixedly engaged with the bushing.

6. The apparatus in accordance with claim 5, wherein the bushing comprises a flange and the bushing is mounted on the driving wheel by using screws threadedly engaging the flange and the driving wheel.

7. The apparatus in accordance with claim 1, wherein the guiding channel means is formed to have a groove-like profile located therein.

8. The apparatus in accordance with claim 1, wherein the circumferential periphery of the driving wheel comprises a left side and a right side and the guiding channel means comprises a first arc-shaped guiding channel extending from the right side of the circumferential periphery of the driving wheel downwardly through the left side thereof to return to the right side thereof, a second arc-shaped guiding channel located opposite to the first arc-shaped guiding channel and extending from the left side of the circumferential periphery of the driving wheel downwardly through the right side thereof to return to the left side thereof, a first horizontal guiding channel located amid the first and second arc-shaped guiding channels and a second horizontal guiding channel located opposite to the first horizontal guiding channel, a first group of curved guiding channels located between the first arc-shaped guiding channel and the first horizontal guiding channel, a second group of curved guiding channels located between the first horizontal guiding channel and the second arc-shaped guiding channel, a third group of curved guiding channels located between the second arc-shaped guiding channel and the second horizontal guiding channel and a fourth group of curved guiding channels located between the second horizontal guiding channel and the first arc-shaped guiding channel, wherein the first group of curved guiding channels each defining a curve having a concave side substantially facing the first arc-shaped guiding channel, an orientation extending from the left side of the circumferential periphery of the driving wheel downwardly to the right side thereof and a length and a curvature gradually decreasing in proportion to their distances from the first arc-shaped guiding channel, the second group of curved guiding channels each defining a curve having a concave side substantially facing the second arc-shaped guiding channel, an orientation extending from the left side of the circumferential periphery of the driving wheel downwardly to the right side thereof and a length and a curvature gradually increasing in proportion to their distances from the first horizontal guiding channel, the third group of curved guiding channels each defining a curve substantially having a concave side substantially facing the second arc-shaped guiding channel, an orientation extending from the left side of the circumferential periphery of the driving wheel upwardly to the right side thereof and a length and a curvature gradually decreasing in proportion to their distances from the second arc-shaped guiding channel, and the fourth group of curved guiding channels each defining a curve having a concave side substantially facing the first arc-shaped guiding channel, an orientation extending from the left side of the circumferential periphery of the driving wheel upwardly to the right side thereof and a length and a curvature gradually increasing in proportion to their distances from the second horizontal guiding channel.

9. The apparatus in accordance with claim 8, wherein each of the first and second arc-shaped guiding channels has a length which is longer than the other guiding channels.

10. The apparatus in accordance with claim 1, wherein the plurality of rollers comprises six rollers.

11. The apparatus in accordance with claim 10, wherein the driven shaft is formed to have an enlarged portion on the circumferential periphery thereof and the six rollers are attached on the enlarged portion and equally spaced from each other.

* * * * *